US011144013B2

(12) United States Patent
Buehler et al.

(10) Patent No.: US 11,144,013 B2
(45) Date of Patent: Oct. 12, 2021

(54) PRESENTATION CASE FOR AN ELECTROMECHANICAL WATCH AND ASSEMBLY COMPRISING THE SAME

(71) Applicant: Harry Winston SA, Plan-les-Ouates (CH)

(72) Inventors: Johnny Buehler, Luins (CH); Jean-Jacques Born, Morges (CH); Cedric Nicolas, Neuchatel (CH)

(73) Assignee: Harry Winston SA, Plan-les-Ouates (CH)

( * ) Notice: Subject to any disclaimer, the term of this patent is extended or adjusted under 35 U.S.C. 154(b) by 458 days.

(21) Appl. No.: 16/167,998

(22) Filed: Oct. 23, 2018

(65) Prior Publication Data

US 2019/0121297 A1 Apr. 25, 2019

(30) Foreign Application Priority Data

Oct. 23, 2017 (EP) ..... 17197737

(51) Int. Cl.
*G04C 9/08* (2006.01)
*G04D 7/00* (2006.01)
*G04C 13/10* (2006.01)

(52) U.S. Cl.
CPC ..... *G04C 9/08* (2013.01); *G04C 13/105* (2013.01); *G04D 7/006* (2013.01)

(58) Field of Classification Search
CPC ..... G04C 9/08; G04C 13/105; G04C 1/00; G04C 1/04; G04C 1/06–067; G04D 7/006; G04D 7/009; G04B 3/006
(Continued)

(56) References Cited

U.S. PATENT DOCUMENTS 5,988,871 A * 11/1999 Bonnet ..... G04D 7/009 368/206
7,167,417 B2 * 1/2007 Akahane ..... G04R 20/00 368/155

(Continued)

FOREIGN PATENT DOCUMENTS

CN 1701283 A 11/2005
CN 105549374 A 5/2016

(Continued)

OTHER PUBLICATIONS

European Search Report dated Apr. 4, 2018 in European Application 17197737.4 filed on Oct. 23, 2017 (with English Translation of Categories of Cited Documents).

(Continued)

*Primary Examiner* — Edwin A. Leon
(74) *Attorney, Agent, or Firm* — Oblon, McClelland, Maier & Neustadt, L.L.P.

(57) ABSTRACT

A presentation case is arranged for receiving an electromechanical watch provided with a stepping motor for driving the watch hands. The presentation case includes a box with a support for receiving the watch, a system for detecting the position of the hands, and a device for resetting the watch connected to the hand position detection system. The resetting device resets the watch based on information received from the hand position detection system and a time reference when the watch is placed on the receiving support. The resetting device includes a driver for the stepping motor of the electromechanical watch, which is arranged inside the presentation case facing the stepping motor, when the watch is placed on the receiving support, and causes a rotation of the stepping motor by inductive coupling.

20 Claims, 3 Drawing Sheets

(58) Field of Classification Search
USPC ..... 368/80
See application file for complete search history.

(56) References Cited

U.S. PATENT DOCUMENTS

| | | | | |
|---|---|---|---|---|
| 9,292,000 | B2 * | 3/2016 | Lamarche | G04B 3/006 |
| 2002/0136092 | A1 | 9/2002 | Sakuyama | |
| 2002/0141290 | A1 | 10/2002 | Sakuyama | |
| 2005/0105401 | A1 | 5/2005 | Akahane et al. | |
| 2005/0254352 | A1 * | 11/2005 | Wolf, V | G04D 7/009 368/206 |
| 2009/0225632 | A1 * | 9/2009 | Agnoff | G04D 7/009 368/207 |
| 2013/0064045 | A1 | 3/2013 | Essery et al. | |
| 2014/0003200 | A1 | 1/2014 | Lamarche | |
| 2015/0198929 | A1 | 7/2015 | Essery et al. | |

FOREIGN PATENT DOCUMENTS

| | | | |
|---|---|---|---|
| EP | 1 553 469 | A1 | 7/2005 |
| JP | 52-068470 | | 6/1977 |
| JP | 02-010189 | | 1/1990 |
| WO | WO 2012/126978 | A1 | 9/2012 |

OTHER PUBLICATIONS

Combined Chinese Office Action and Search Report dated Jul. 10, 2020 in Chinese Patent Application No. 201811230049.0 (with English translation and English translation of Category of Cited Documents), 18 pages.

* cited by examiner

PRESENTATION CASE FOR AN ELECTROMECHANICAL WATCH AND ASSEMBLY COMPRISING THE SAME

This application claims priority from European patent application No. 17197737.4 filed on Oct. 23, 2017, the entire disclosure of which is hereby incorporated herein by reference.

FIELD OF THE INVENTION

The invention concerns a presentation case for an electromechanical watch provided with a stepping motor for driving the watch hands.

The invention also concerns an assembly comprising the presentation case and an electromechanical watch provided with a stepping motor.

BACKGROUND OF THE INVENTION

In the field of electromechanical watches with hands, there are known systems for correcting the time displayed by the watch. Such systems make it possible to reset the watch, for example in the case of a time zone change or of a summer/winter time change.

Such a time correction system is, for example, described in European Patent Application No EP 1 553 469 A1. The system is provided with a time correction instruction device, comprising, in an example embodiment, a computer connected to a camera and to a time correction signal generating circuit. The watch includes communication means for receiving time correction data contained in the signal and means for moving the hands to the exact time. The watch can be placed on a frame with the time indicated by the hands visible on the top, and the camera can take a photograph of the position of the hands, which is sent to the computer to recognise the time displayed by the watch. The computer then generates correction data including a reference time, and transmits this data to the watch, via the signal generating circuit. However, one drawback of such a system is that it requires modification of the watch movement in order to incorporate the communication means and means for moving the hands. Further, such a system is bulky and restrictive, requiring, in particular, the use of a computer for the time correction.

To overcome the aforementioned drawback, there are known watch presentation cases adapted to receive a watch on a support and comprising means for resetting the watch. Patent Application WO 2012/126978 A1, which discloses such a presentation case, can be cited in this regard. According to a particular example embodiment, the presentation case described in this document includes a removable support that receives the watch and a watch winding device connected to a camera. The winding device includes data analysis means. Once the watch is placed on the removable support of the presentation case, the camera stores an image of the position of the hands and sends it to the analysis means. Said means then determine the time displayed by the watch and, through comparison with a time reference, transmit a time correction instruction to the winding device. The winding device then winds the watch by direct mechanical action on the winding button. However, one drawback of the proposed presentation case is that it is mechanically complex, and it is limited to resetting watches which have a winding button.

SUMMARY OF THE INVENTION

It is thus an object of the invention to provide a presentation case for an electromechanical watch provided with a stepping motor, which makes it possible to automatically reset the watch, in an easy and non-restrictive manner, and overcomes the aforementioned drawbacks of the state of the art.

To this end, the invention concerns a presentation case for an electromechanical watch provided with a stepping motor for driving the watch hands, the presentation case comprising:

a box comprising a support for receiving the watch, the presentation case being configured to contain a predefined type and/or shape of electromechanical watch;

a system for detecting the position of the watch hands;

means for resetting the watch, connected to the hand position detection system, and configured to reset the watch on the basis of information received from the hand position detection system, when the watch is placed on the receiving support;

wherein the presentation case is configured to contain a predefined type and/or shape of electromechanical watch, and wherein the resetting means include a stepping motor drive means specific to the type of electromechanical watch, the drive means being arranged inside the presentation case so as to face the stepping motor when the watch is placed on the receiving support, and being configured to cause a direct rotation of a rotor of a stepping motor by inductive coupling.

An electromechanical watch, such as an electromechanical quartz watch, typically includes a stepping motor, such as a Lavet motor, which drives the watch hands by means of a gear train.

One advantage of the presentation case of the invention lies in the fact that the means for resetting the watch include a stepping motor drive means, configured to control direct rotation of a rotor of the stepping motor by inductive coupling. The drive means is arranged in the presentation case so as to face the stepping motor when the watch is placed on the receiving support. Thus, the electromechanical watch is reset easily and quickly inside the presentation case, by the inductive coupling action of the drive means directly on the stepping motor.

Another advantage of the present invention is that the resetting system that it proposes does not require any modification of the watch movement. The presentation case is thus functional for any electromechanical watch movement provided with a stepping motor, without requiring any modification of said movement.

According to a first embodiment of the invention, the drive means includes at least one coil mounted on a ferromagnetic coil by ferromagnetic core and powered via electrical power means.

According to a second embodiment of the invention, the drive means includes a rotatably mounted magnet. One advantage of this second embodiment is that it makes it possible to rotate the stepping motor, and therefore the hands, in both directions of rotation. This advantageously makes it possible to reduce the time taken to reset the watch.

Advantageously, the presentation case further includes a flap portion mounted on the box, an optical system for detecting the position of the hands being fixed inside the flap portion so as to face the watch hands when the flap portion is closed onto the box and the watch is placed on the receiving support. This optimises the space inside the presentation case, by freeing space inside the box. The flap portion is, for example, a lid.

Advantageously, the presentation case further includes a lid, and a sensor detecting the presence of the watch and/or closure of the lid. Said sensor is connected to the watch resetting means, the resetting means being configured to start a watch resetting process based on a detection signal received from the sensor. This allows the watch resetting process to be completed automated, from the moment that the watch is placed on the receiving support and/or that the lid is closed.

To this end, the invention also concerns an assembly including an electromechanical watch provided with a stepping motor, and a presentation case for receiving the watch as above-mentioned.

BRIEF DESCRIPTION OF THE DRAWINGS

The objects, advantages and features of the presentation case for an electromechanical watch will appear more clearly in the following description based on at least one non-limiting embodiment, illustrated by the drawings, in which.

DETAILED DESCRIPTION OF THE INVENTION

In the following description, reference is made to a presentation case for an electromechanical watch, especially a presentation case for an electromechanical quartz watch. All the electronic components of the presentation case, which are well known to those skilled in the art in this technical field, will be described only in a simplified manner. In particular, those skilled in the art will know how to adapt these various electronic components and make them work together to operate the presentation case.

Figure 1:
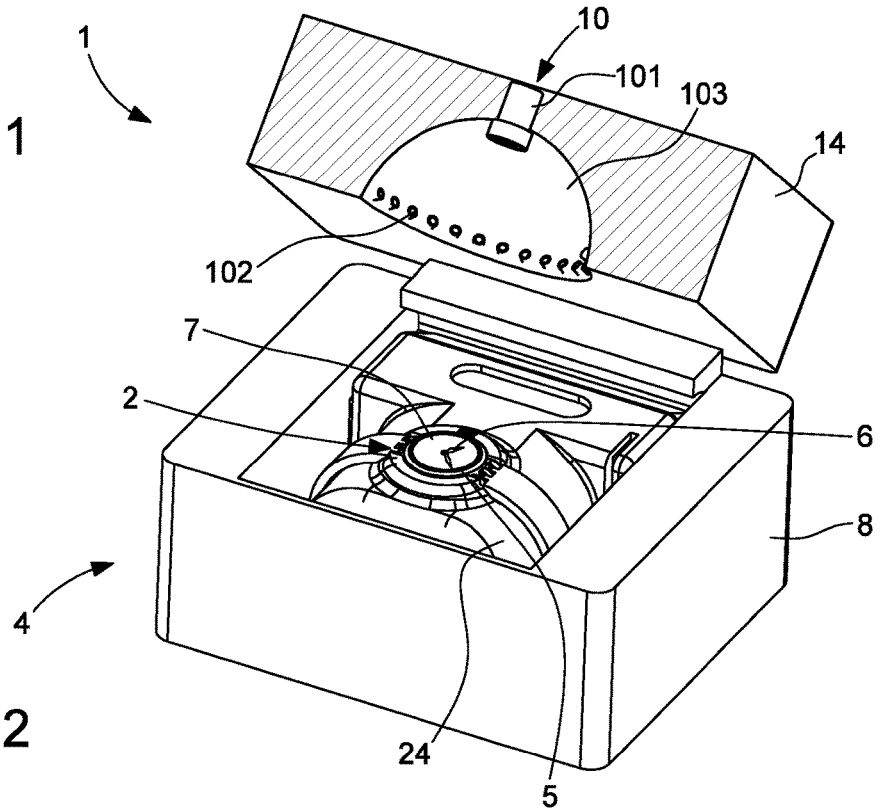
FIG. 1 is a perspective view of an assembly comprising an electromechanical watch and a presentation case according to the invention.

FIG. 1 represents an assembly 1, which includes an electromechanical watch 2 and a presentation case 4 for receiving watch 2. Electromechanical watch 2 is provided with a watch case 5, which can be made from any diamagnetic material conventionally used in horology. Watch case 5 may also be made of a paramagnetic, non-magnetic, sapphire or weakly ferromagnetic material. Watch case 5 contains a timepiece movement (not represented) of ordinary design; and a dial above which move display means formed of hands 6. The dial is protected by a crystal 7, which closes watch case 5. In a conventional manner, watch case 5 also contains a stepping motor (not represented) for driving hands 6 of the watch via a gear train of the timepiece movement. Such a stepping motor is typically a Lavet motor. Watch 2 is, for example, a quartz watch, although this is not limiting in the context of the present invention.

In FIG. 1, presentation case 4 further includes a system 10 for detecting the position of hands 6. The detection system includes at least one camera 101 arranged inside a lid 14 for closing the presentation case, above hands 6 of watch 2, which is placed on a watch receiving support 24. A set of light sources 102 can also be arranged in an inner dome 103 of lid 14 and form, for example, a circle of light sources 102 parallel to the lid closure plane. The light sources, which may be light emitting diodes, are preferably regularly spaced apart. Camera 101 is situated on the top part of the dome and centred with respect to the circle of light sources 102. Inner dome 103 allows the light generated by the light sources to be diffused to facilitate detection of the position of hands 6 by camera 101. Naturally, an optical sensor may also be provided instead of a camera for detecting the position of the watch hands.

Figure 2:
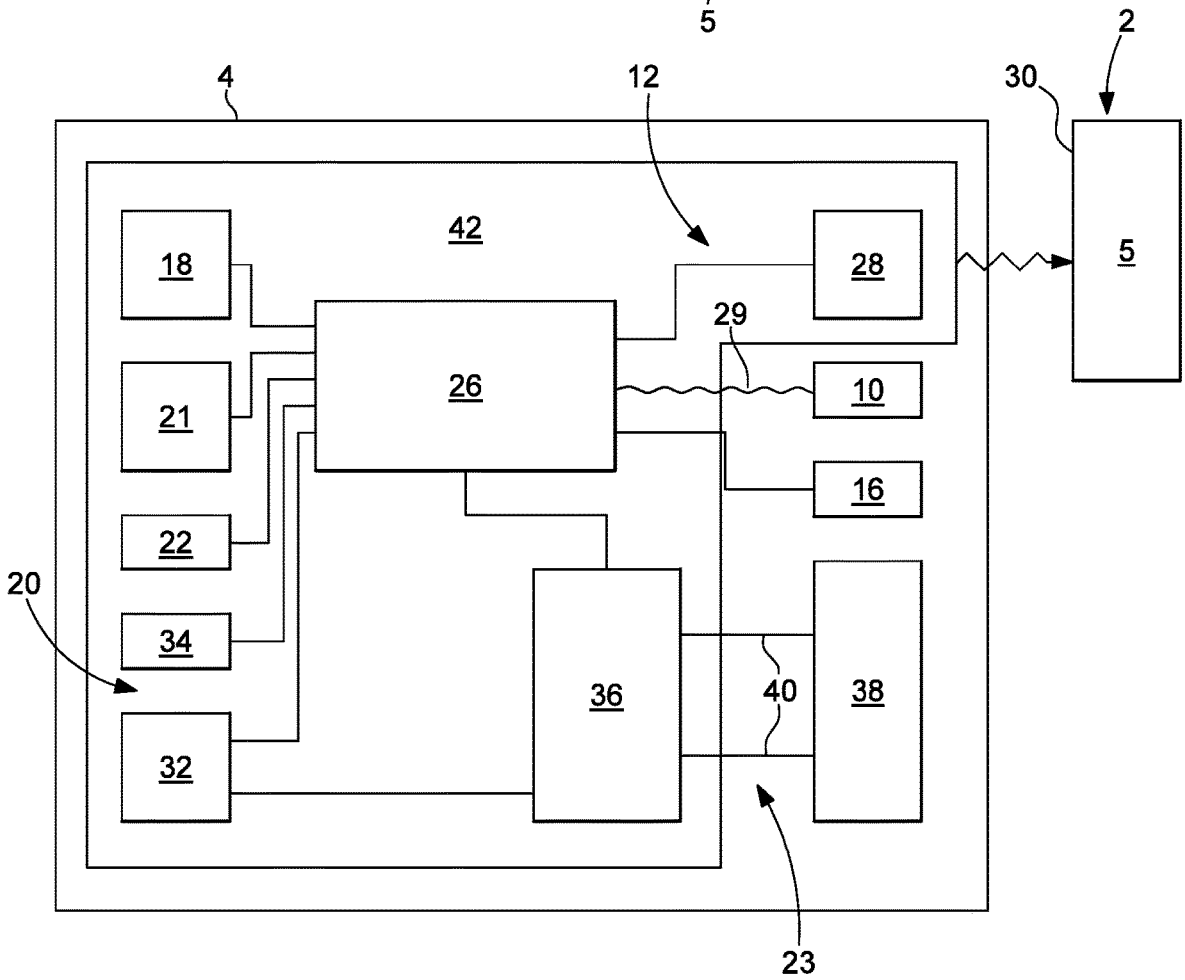
FIG. 2 represents a simplified block diagram of the electronic components of the presentation case of FIG. 1 according to an example embodiment.

Presentation case 4 includes a box 8. As illustrated in FIG. 2, presentation case 4 further includes a system 10 for detecting the position of the hands 6 of watch 2 and means 12 for resetting watch 2. In the example embodiment illustrated in FIG. 1, presentation case 4 further includes a lid 14 mounted on box 8. According to a preferred embodiment illustrated in FIG. 2, presentation case 4 also includes a sensor 16 for detecting the presence of watch 2 and/or closure of lid 14. Preferably, presentation case 4 can also include display and activation means 18, communication means 20, a mobile telephone signal receiver 21, a radio or GPS (Global Positioning System) signal receiver 22, a very precise and temperature-compensated time base, and electrical power means 23.

Preferably, presentation case 4 is configured to contain a predefined type and/or shape of electromechanical watch 2. For this purpose, box 8 includes a support 24 for receiving watch 2, adapted to the type and/or shape of watch 2. A support 24 of this type can be seen, in particular, in FIGS. 3 to 5.

As illustrated in FIG. 2, system 10 for detecting the position of hands 6 is connected to means 12 for resetting watch 2. Preferably, system 10 for detecting the position of hands 6 is an optical system. According to a first example embodiment, system 10 for detecting the position of hands 6 includes a camera 101 shown in FIG. 1. Camera 101 is arranged to substantially face hands 6 of watch 2, when watch 2 is placed on receiving support 24. For this purpose, the camera is, for example, fixed inside lid 14 so as to substantially face hands 6, when lid 14 is closed onto box 8. As shown in FIG. 1, camera 101, which may, for example, be provided with an additional system consisting of light emitting diodes 102 inside a dome 103 and intended to illuminate watch 2, is, for example, fixed in such a position on lid 14 that it is at a distance from crystal 7 of watch case 5 substantially comprised between 3 and 4 cm, when lid 14 is closed onto box 8. The advantage of such a camera 101 is that it saves time in resetting watch 2, and the hand position detection that it provides is independent of the shape of watch 2. Because camera 101 does not need to be positioned precisely opposite hands 6 of watch 2, it is possible to use a relatively standard presentation case as case 4. The use of a camera 101 as the hand position detection system is especially suitable in the case of a watch with hands that has a calendar mechanism.

According to a second embodiment example, system 10 for detecting the position of hands 6 includes an optical sensor (not represented). The optical sensor is arranged to be precisely opposite hands 6 of watch 2 when watch 2 is placed on receiving support 24. For this purpose, the optical sensor is, for example, fixed inside lid 14 so as to face hands 6, when lid 14 is closed onto box 8. The optical sensor is, for example, fixed in such a position on lid 14 that it is flush with crystal 7 of watch case 5, for example at a distance of a few millimetres, when lid 14 is closed on box 8. The advantage of such an optical sensor is that it is a relatively simple and inexpensive component.

Resetting means 12 are configured to reset watch 2 on the basis of information received from system 10 for detecting the position of hands 6, when watch 2 is placed on receiving support 24. For this purpose, resetting means 12 include data analysis means 26, a time reference, and a means 28 for driving the stepping motor of watch 2.

As represented in FIG. 2, data analysis means 26 are connected to stepping motor drive means 28 of watch 2, to sensor 16 for detecting the presence of watch 2 and/or closure of lid 14, to display and activation means 18, to an internal time reference, to wired or wireless communication means 20, to mobile telephone signal receiver 21, to radio or GPS signal receiver 22, and to electrical power means 23. Data analysis means 26 are also connected to system 10 for detecting the position of hands 6, for example via a flexible electronic circuit 29. Data analysis means 26 are for example formed of a microprocessor. The microprocessor can also store a time reference.

Figure 3:
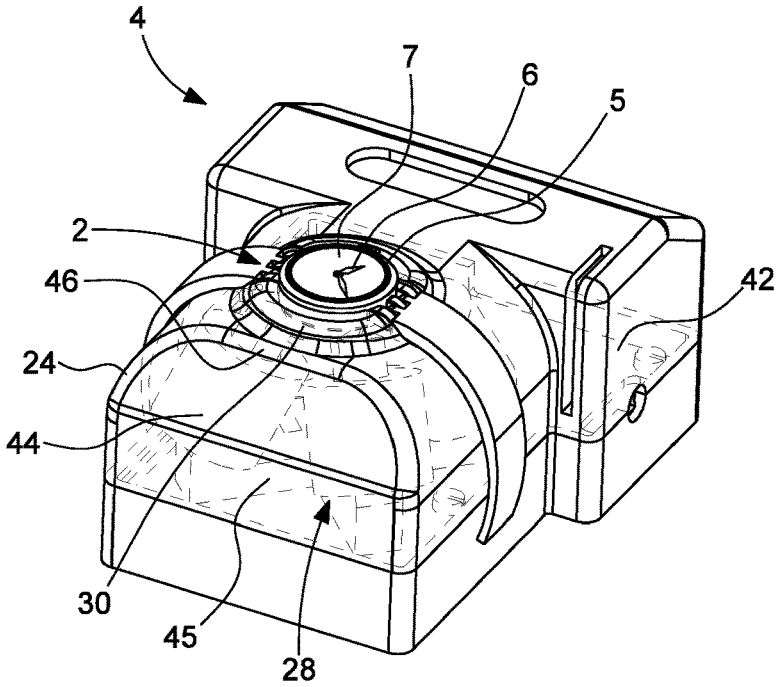
FIG. 3 is a perspective view of one part of the presentation case according to a first embodiment of the invention.
Figure 4:
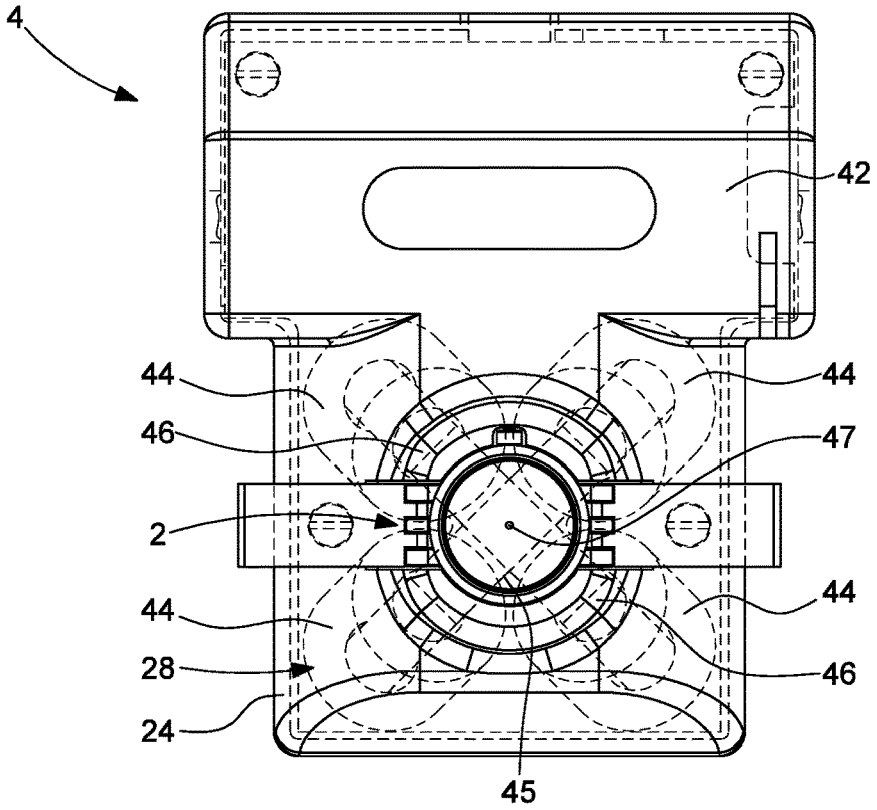
FIG. 4 is a top view of the presentation case of FIG. 3.
Figure 5:
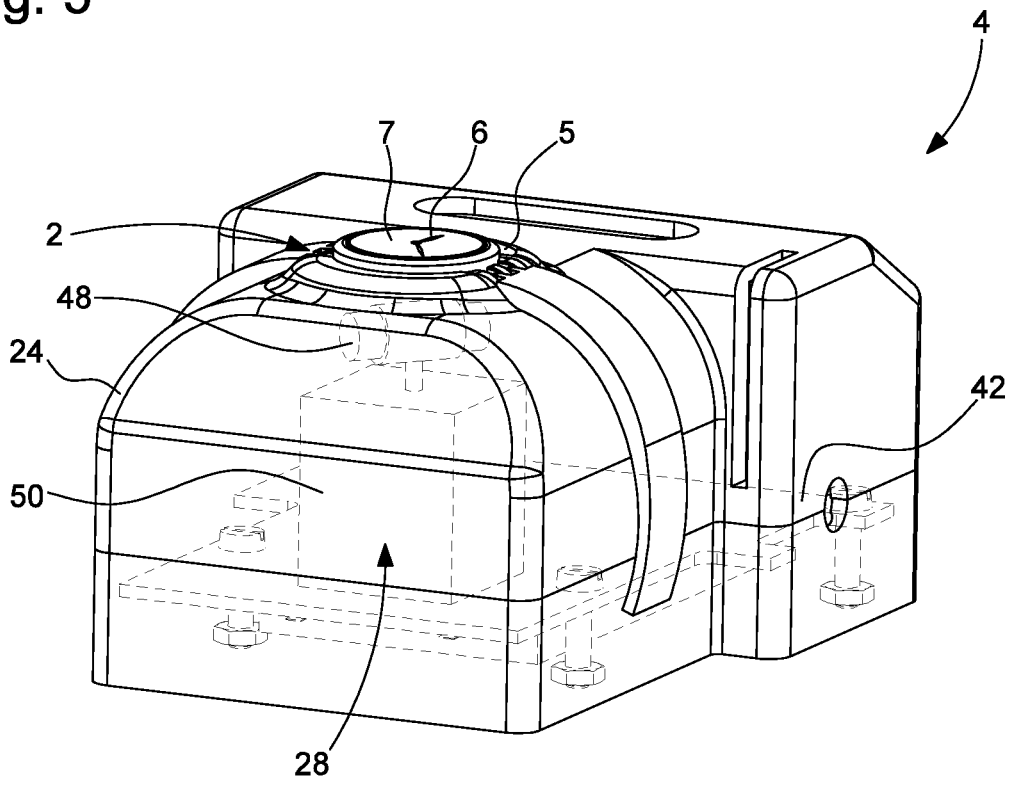
FIG. 5 is a perspective view of one part of the presentation case according to a second embodiment of the invention.

Stepping motor drive means 28 of watch 2 is arranged inside presentation case 4 so to face the stepping motor when watch 2 is placed on receiving support 24. Preferably, drive means 28 is arranged inside presentation case 4 so as to be on the back cover 30 side of watch case 5 when watch 2 is placed on receiving support 24, facing said back cover 30. For this purpose, drive means 28 is, for example, arranged inside receiving support 24, as illustrated in FIGS. 3 to 5. Drive means 28 is configured to control rotation of the stepping motor rotor of watch 2 by inductive coupling. Different example embodiments of drive means 28 will be described in detail below, with reference to FIGS. 3 to 5.

Sensor 16 for detecting the presence of watch 2 and/or closure of lid 14 is, for example, fixed inside presentation case 4, inside or outside receiving support 24. The watch presence sensor 16 is for example a feeler arm arranged inside presentation case 4 so as to face the back cover 30 side of watch case 5 when watch 2 is placed on receiving support 24, facing said back cover 30. In a variant that is not represented, the sensor for detecting the presence of watch 2 and/or closure of lid 14 is formed by optical system 10 for detecting the position of hands 6 of watch 2. Data analysis means 26 are, for example, configured to start a process of resetting watch 2 on the basis of a detection signal received from sensor 16, as will be described in detail below.

Display and activation means 18 include, for example, several activation buttons and several light emitting diodes. The light emitting diodes are intended to provide visual indications relating to the operation of presentation case 4, and in particular to the resetting of watch 2.

As illustrated in FIG. 2, communication means 20 include, for example, a micro USB socket 32 and a module 34 for communication with a mobile communication device (not represented) together with an antenna. Micro USB socket 32 is connected to electrical power means 23 and is intended to allow charging of said means, via an external electrical power source compatible with the USB format. Communication module 34 is, for example, a bidirectional communication module compliant with the Bluetooth standard. In a variant, communication module 34 can be a bidirectional communication module compliant with the NFC standard, or a unidirectional communication module of the 'light programming' type.

Mobile telephone signal receiver 21, for example for a GSM signal, is provided with a communication module and with a signal receiver antenna.

Radio or GPS signal receiver 22 is provided with a communication module and with a signal receiver antenna.

As illustrated in FIG. 2, electrical power means 23 include, for example, a charger 36 and an accumulator 38. Charger 36 is connected to data analysis means 26 and to micro USB socket 32. Accumulator 38 is connected to charger 36, for example by two electrical wires 40.

In the example embodiment illustrated in FIG. 2, data analysis means 26, stepping motor drive means 28 of watch 2, display and activation means 18, communication means 20, mobile telephone signal receiver 21, radio or GPS signal receiver 22, and charger 36 are all connected on a common printed circuit 42.

Preferably, resetting means 12, in particular data analysis means 26, are adapted to set watch 2 according to the current time. The current time is synchronised by means of a reference system, for example an embedded or remote reference system. A remote reference system includes, for example, the reception, by receiver 22, of a radio or GPS signal, or the reception, by communication means 20, of a signal from a computer network, or the reception, by receiver 21, of a mobile telephone signal. The reception of one or more of these signals allows the time reference stored in microprocessor 26 or in printed circuit 42 to be updated. For example, such a time reference can be provided by a precision quartz placed on printed circuit 42.

A first embodiment of the invention will now be described with reference to FIGS. 3 and 4. According to this first embodiment, stepping motor drive means 28 of watch 2 includes at least one coil 44. In the example embodiment illustrated in FIGS. 3 and 4, drive means 28 includes four coils 44. As illustrated in FIG. 4, in this example, the four coils 44 are connected in diagonal pairs via two magnetic conductors 45, substantially forming a symmetrical cross-shape, with coils 44 arranged at the ends of the cross. Coils 44 are advantageously arranged such that the centre 47 of the cross thereby formed substantially faces the centre of watch case 5 once the latter is placed on receiving support 24, when watch case 5 defines a symmetry of revolution. This particular arrangement of the four coils 44 makes it possible to obtain a rotating magnetic field, once the coils are electrically powered. This rotating magnetic field induces a direct magnetic coupling with the stepping motor of watch 2. Coils 44 are, for example, selected such that the value of this magnetic field is typically on the order of 0.02 Teslas. One advantage of the use of four coils 44 so arranged is that they make it possible to rotate the stepping motor of watch 2, and therefore hands 6, in both directions of rotation.

Coils 44 are each mounted on a ferromagnetic core 46 and are powered via an electrical power source. Ferromagnetic cores 46 are, for example, formed of a soft ferromagnetic metal. Preferably, the electrical power source is formed by electrical power means 23. In the example embodiment illustrated in FIGS. 3 and 4, the four coils 44 are tilted with respect to the plane of printed circuit 42, towards the interior of centre 47 of the cross-arrangement that they define. Coils 44 are tilted at an angle with the plane of printed circuit 42, the value of this angle being identical for all four coils 44. This arrangement advantageously makes it possible to create a horizontal magnetic field inside coils 44, so that the rotating magnetic field engages substantially horizontally with the stepping motor of watch 2. This improves the magnetic coupling efficiency.

In a variant that is not represented, drive means 28 can, for example, comprise two coils 44. This variant makes it possible to obtain a horizontal magnetic field once coils 44 are electrically powered. This only allows hands 6 of watch 2 to be rotated in one direction of rotation. In this variant, coils 44 are, for example, chosen such that the value of the magnetic field produced is typically on the order of 0.02 Teslas.

FIG. 5 illustrates a second embodiment of the invention in which elements similar to the first embodiment described above are identified by the same references, and are not, therefore, described again.

According to this second embodiment, stepping motor drive means 28 of watch 2 does not include any coils, but includes a rotatably mounted magnet 48. In the example embodiment illustrated in FIG. 5, magnet 48 is rotatably mounted by means of an electric motor 50 powered via electrical powering means 23. Magnet 48 is mounted on the arbor of electric motor 50.

Rotating magnet 48 makes it possible to obtain a rotating magnetic field, once electric motor 50 is electrically powered. This rotating magnetic field induces a magnetic coupling with the stepping motor of watch 2. Magnet 48 is, for example, chosen such that the value of this magnetic field is typically on the order of 0.02 Teslas.

The speed of electric motor 50 is controlled by microprocessor 26. Electric motor 50 is, for example, a continuous current motor provided with an encoder. In a variant, electric motor 50 may be a stepping motor.

One advantage of using a rotatably mounted magnet 48 is that it makes it possible to rotate the stepping motor of watch 2, and therefore hands 6, in both directions of rotation. This advantageously makes it possible to reduce the time taken to reset watch 2.

The operation of presentation case 4 according to the invention will now be described. Watch 2 is initially placed inside presentation case 4, on receiving support 24.

The process for resetting watch 2, implemented by presentation case 4, can be started either manually by a user, or automatically.

In the case where the process is started manually by a user, after closing lid 14, the user presses, for example, on an activation button belonging to display and activation means 18.

In the case where presentation case 4 includes a sensor 16 for detecting the presence of watch 2 and/or closure of lid 14, the resetting process is started automatically, following a detection by sensor 16. Sensor 16 then transmits a detection signal to analysis means 26, which starts the resetting process.

In both cases, detection system 10, controlled by analysis means 26, starts detecting the position of hands 6 of watch 2, and transmits the hand position data to means 12 for resetting watch 2. More specifically, analysis means 26 receive the hand position data and compare it to the available time reference. The time reference could be updated by analysis means 26, via a remote reference system. The reception by analysis means 26 of a time reference signal, for example, enables this update. Analysis means 26 then determines, as a function of the comparison result, a command to reset watch 2 to the current time and transmits this command to drive means 28. Drive means 28 then causes a rotation, via inductive coupling, of the stepping motor rotor of watch 2, which allows a movement of hands 6, driven by the motor. The stepping motor of watch 2 is then driven in rotation, until hands 6 reach a position corresponding to the current time, which ends the process. An optical check of the correct position of the hands can be added, if required.

An example of an automatic start of the process for resetting a watch 2 with two hands 6, in the particular case where presentation case 4 includes a presence sensor for watch 2 and where detection system 10 includes an optical sensor, is provided by the following sequence:

detection, by sensor 16, of the presence of watch 2 inside presentation case 4;

start, by analysis means 26, of the process of resetting watch 2;

transmission to drive means 28, by analysis means 26, of a command to rotate the stepping motor of watch 2;

high speed rotation (typically at a frequency of 60 Hz), by drive means 28, of the stepping motor of watch 2. If the stepping motor is actuated in normal mode every 20 seconds, namely 180 positions per revolution for the minute hand, a maximum of 36 seconds is required to move the two hands 6 past the optical sensor;

detection, by the optical sensor, of the position of hands 6 and transmission of the position data for hand 6 to analysis means 26;

calculation, by analysis means 26, of the new position of hands 6 according to the internal time reference;

transmission to drive means 28, by analysis means 26, of a command to reset watch 2 to the current time;

high speed positioning (typically at a frequency of 60 Hz), by drive means 28, of hands 6 of watch 2.

In the variant wherein detection system 10 includes a camera and not an optical sensor, the first step of rotating the stepping motor of watch 2, to move hands 6 past the detection system, is no longer necessary.

What is claimed is:

1. A presentation case for an electromechanical watch provided with a stepping motor for driving hands of the watch, the presentation case comprising:

a box comprising a support for receiving the watch, the presentation case is sized to contain an electromechanical watch;

a hand position detection system that detects a position of the hands of the watch;

means for resetting the watch, connected to the hand position detection system, and configured to reset the watch based on information received from the hand position detection system, when the watch is placed on the receiving support;

wherein the resetting means include a stepping motor drive means that generates a magnetic field to cause a direct rotation of a rotor of the stepping motor by inductive coupling, the drive means being arranged inside the presentation case so as to face the stepping motor when the watch is placed on the receiving support.

2. The presentation case according to claim 1, wherein the drive means includes at least one coil mounted on a ferromagnetic core and powered via electrical power means.

3. The presentation case according to claim 2, wherein ferromagnetic core is formed of a soft ferromagnetic metal.

4. The presentation case according to claim 1, wherein drive means includes a rotatably mounted magnet.

5. The presentation case according to claim 4, wherein the magnet is mounted on an arbor of an electric motor.

6. The presentation case according to claim 1, wherein the drive means is arranged inside the presentation case so as to be on a back cover side of the watch case when the watch is placed on the receiving support, facing said back cover.

7. The presentation case according to claim 1, wherein the hand position detection system is an optical system.

8. The presentation case according to claim 7, wherein the optical hand position detection system includes a camera arranged so as to substantially face the hands of the watch when the watch is placed on the receiving support.

9. The presentation case according to claim 7, wherein the optical hand position detection system includes an optical sensor arranged so as to face the hands of the watch when the watch is placed on the receiving support.

10. The presentation case according to claim 7, wherein the presentation case further includes a flap portion mounted on the box, the optical system being fixed inside the flap portion so as face the hands of the watch when the flap portion is closed onto the box and the watch is placed on the receiving support.

11. The presentation case according to claim 1, wherein the drive means includes four coils, which are connected in diagonal pairs via two magnetic conductors, substantially forming a symmetrical cross-shape, wherein the coils are arranged at the ends of the cross, and wherein the coils are arranged such that a centre of the cross so formed substantially faces the centre of a watch case placed on the receiving support so as to generate a rotating field once the coils are electrically powered in order to rotate the rotor of the stepping motor of the watch in both directions of rotation.

12. The presentation case according to claim 1, wherein the presentation case further includes a lid, and a sensor for detecting the presence of the watch and/or closure of the lid; said sensor being connected to the means for resetting the watch, the resetting means being configured to start a watch resetting process based on a detection signal received from the sensor.

13. The presentation case according to claim 1, wherein the means for resetting the watch are adapted to set the time of the watch according to the current time, the current time being synchronized by means of a reference system.

14. The presentation case according to claim 13, wherein the reference system is a remote reference system, which includes the reception of a radio or GPS signal, or a signal from a computer network or mobile telephone signal.

15. The presentation case according to claim 1, wherein the presentation case further includes means of communication with a mobile communication device.

16. An assembly comprising:

an electromechanical watch including a stepping motor, and a presentation case that receives the watch, wherein the presentation case comprises:

a box comprising a support to receive the watch, a hand position detection system that detects a position of hands of the watch, means for resetting the watch, connected to the hand position detection system, and configured to reset the watch based on information received from the hand position detection system, when the watch is placed on the receiving support, wherein the resetting means include a stepping motor drive means that generates a magnetic field to cause a direct rotation of a rotor of the stepping motor by inductive coupling, the drive means being arranged inside the presentation case so as to face the stepping motor when the watch is placed on the receiving support.

17. The assembly according to claim 16, wherein the drive means includes at least one coil mounted on a ferromagnetic core and powered via electrical power means.

18. The assembly according to claim 17, wherein ferromagnetic core is formed of a soft ferromagnetic metal.

19. The assembly according to claim 16, wherein drive means includes a rotatably mounted magnet.

20. The assembly according to claim 19, wherein the magnet is mounted on an arbor of an electric motor.

* * * * *